US009301593B2

(12) United States Patent
Mahoney et al.

(10) Patent No.: US 9,301,593 B2
(45) Date of Patent: Apr. 5, 2016

(54) PACKAGING SYSTEMS AND METHODS

(71) Applicant: L'OREAL, Paris (FR)

(72) Inventors: Zachary Mahoney, Freehold, NJ (US); Wenzhen Cheng, Annandale, NJ (US); Anthony Drouin, Jersey City, NJ (US); Thomas Kearney, Beacon, NY (US); Ludovic LeCaro, Morristown, NJ (US)

(73) Assignee: L'OREAL, Paris (FR)

( * ) Notice: Subject to any disclaimer, the term of this patent is extended or adjusted under 35 U.S.C. 154(b) by 6 days.

(21) Appl. No.: 14/041,909

(22) Filed: Sep. 30, 2013

(65) Prior Publication Data

US 2015/0093173 A1 Apr. 2, 2015

(51) Int. Cl.

| | |
|---|---|
| ***A45D 40/26*** | (2006.01) |
| ***A45D 34/04*** | (2006.01) |
| *A45D 34/00* | (2006.01) |
| *A45D 40/00* | (2006.01) |

(52) U.S. Cl.

CPC ..... *A45D 40/265* (2013.01); *A45D 34/045* (2013.01); *A45D 2034/007* (2013.01); *A45D 2040/0025* (2013.01); *A45D 2200/053* (2013.01)

(58) Field of Classification Search

CPC ..... A45D 2034/007; A45D 2200/053
USPC ..... 401/126, 192, 194
See application file for complete search history.

(56) References Cited

U.S. PATENT DOCUMENTS

| | | | | |
|---|---|---|---|---|
| 2,351,395 | A | 6/1944 | Broder | |
| 4,603,993 | A * | 8/1986 | Jung | 401/195 |
| 5,984,550 | A * | 11/1999 | Chuang | 401/57 |
| 6,726,387 | B2 | 4/2004 | Dumler et al. | |
| 7,997,285 | B2 | 8/2011 | Fischer et al. | |
| 8,657,517 | B1 * | 2/2014 | Shinn et al. | 401/195 |
| 2007/0234605 | A1 | 10/2007 | Coleman et al. | |
| 2007/0292199 | A1 * | 12/2007 | Waldinger et al. | 401/192 |
| 2011/0120907 | A1 | 5/2011 | Haile | |
| 2011/0176854 | A1 | 7/2011 | Nobles | |

FOREIGN PATENT DOCUMENTS

| | | | |
|---|---|---|---|
| EP | 1 527 712 | B1 | 8/2006 |
| EP | 1 645 205 | B1 | 8/2008 |
| KR | 10-2013-0046488 | A | 5/2013 |

(Continued)

OTHER PUBLICATIONS

International Search Report and Written Opinion for PCT/US2014/057979, dated Jan. 2, 2015.

Web site: Beauty plus, Dior addict ultra gloss, <http://www.beautypl.co.kr/product/pd_commentview.asp?pro_idx=612&r1dx=4728>, Apr. 15, 2011.

(Continued)

*Primary Examiner* — David Walczak
*Assistant Examiner* — Joshua Wiljanen
(74) *Attorney, Agent, or Firm* — The Marbury Law Group, PLLC

(57) ABSTRACT

A packaging system for a cosmetic product is disclosed. The system includes a reservoir for holding a cosmetic product. The reservoir defines an open end of the reservoir and a closed end opposite the open end of the reservoir. The system further includes a casing positioned at least partially over the reservoir, wherein at least a portion of the casing is transparent for observing the reservoir through the casing, and wherein a size and/or shape of the reservoir as observed through the casing appears different than an actual size and/or shape of the reservoir.

25 Claims, 9 Drawing Sheets

(56) References Cited

FOREIGN PATENT DOCUMENTS

| | | | |
|---|---|---|---|
| WO | 00/02788 | A1 | 1/2000 |
| WO | 2013/111932 | A1 | 8/2013 |

OTHER PUBLICATIONS

English language abstract of KR 10-2013-0046488A (May 8, 2013).
English language abstract of WO 2013-111932A1 (Aug. 1, 2013).

* cited by examiner

PACKAGING SYSTEMS AND METHODS

TECHNICAL FIELD

The present disclosure relates to packaging systems and methods for consumer products, such as, for example, cosmetic products.

INTRODUCTION

The section headings used herein are for organizational purposes only and are not to be construed as limiting the subject matter described in any way.

To enhance the appeal and marketability of a consumer product beyond the product itself, manufacturers often attempt to present traditional consumer products, such as, for example, cosmetic products, in interesting and varied packaging configurations.

Various challenges can arise, however, when attempting to provide interesting and appealing packaging concepts while also maintaining various technical requirements for the packaging and product being packaged. To enhance their appeal and marketability, various liquid and semi-liquid (e.g., gels, etc.) cosmetic products, such as, for example, lip gloss, lip balm, eye shadow, mascara, eye liner, and concealer may, for example, be packaged in uniquely shaped reservoirs that hold the products. Although such reservoirs may be configured to present various interesting and varied designs and/or shapes, for example, for aesthetic purposes, each reservoir also desirably must meet certain functional or technical requirements. For example, some reservoirs may have volumes that are large enough to accommodate a chosen applicator for the product and/or a desired volume of product. Labeling may also be a parameter of consideration for the overall packaging of a product. Such size and other technical parameters can therefore provide countervailing considerations to aesthetic purposes for designs for the product packaging.

It may be desirable, therefore, to provide packaging systems and methods that address these countervailing considerations and meet various desirable technical parameters (e.g., volume and size) while also presenting the product packaging to achieve aesthetic purposes.

SUMMARY

Various exemplary embodiments of the present disclosure may solve one or more of the above-mentioned problems and/or may demonstrate one or more of the above-mentioned desirable features. Other features and/or advantages may become apparent from the description that follows.

In accordance with various exemplary embodiments, a packaging system for a cosmetic product includes a reservoir for holding a cosmetic product. The reservoir defines an open end of the reservoir and a closed end opposite the open end of the reservoir. The system further includes a casing positioned at least partially over the reservoir, wherein at least a portion of the casing is transparent for observing the reservoir through the casing, and wherein a size and/or shape of the reservoir as observed through the casing appears different than an actual size and/or shape of the reservoir.

In accordance with various additional exemplary embodiments, a method for packaging a cosmetic product includes configuring a transparent casing for positioning at least partially over a reservoir configured to hold a cosmetic product such that a size and/or shape of the reservoir as observed through the casing appears different than an actual size and/or shape of the reservoir.

Additional objects and advantages will be set forth in part in the description which follows, and in part will be obvious from the description, or may be learned by practice of the present disclosure. At least some of those objects and advantages may be realized and attained by means of the elements and combinations particularly pointed out in the appended claims and their equivalents.

It is to be understood that both the foregoing general description and the following detailed description are exemplary and explanatory only and are not restrictive of the present disclosure or claims.

BRIEF DESCRIPTION OF THE DRAWINGS

The present disclosure and claims can be better understood from the following detailed description either alone or together with the accompanying drawings. The drawings are included to provide a further understanding, and are incorporated in and constitute a part of this specification. The drawings illustrate one or more exemplary embodiments of the present disclosure and together with the description serve to explain various principles and operation.

DETAILED DESCRIPTION OF VARIOUS EXEMPLARY EMBODIMENTS

Figure 1:
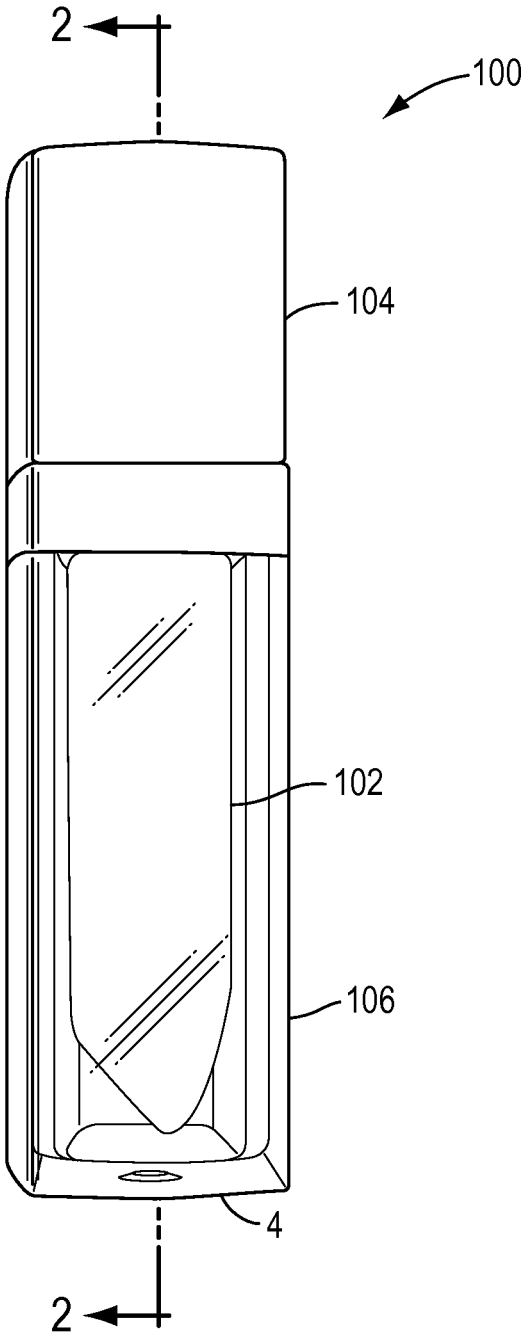
FIG. 1 is a front perspective view of an exemplary embodiment of a packaging system for a cosmetic product in a closed configuration in accordance with the present disclosure.

Reference will now be made in detail to various exemplary embodiments of the present disclosure, examples of which are illustrated in the accompanying drawings.

To enhance the appeal and marketability of a consumer product, such as, for example, a cosmetic product, the product may be packaged in a uniquely shaped reservoir that holds the product. In various exemplary embodiments of the present disclosure, for example, the reservoir may be configured to have an external appearance that resembles a familiar cosmetic product. For example, in the case of a liquid or semi-liquid lip gloss or lip gel, the reservoir may have an external appearance resembling a bullet of lipstick that is received in a transparent casing. In various additional exemplary embodiments, in the case of a liquid or semi-liquid eye shadow, the reservoir may have an external appearance resembling a bullet that is received in a transparent casing. These examples are non-limiting and the present disclosure contemplates a variety of other types of cosmetic products and reservoir configurations as well. To achieve the aesthetic expectation (e.g., of a bullet of lipstick), while also providing the ability to have a reservoir that is large enough to meet various technical parameters of the package (i.e., applicator size, product volume, and/or labeling requirements, etc.), various exemplary embodiments of the present disclosure contemplate a casing positioned over the reservoir that may manipulate the external appearance of the reservoir. Various embodiments, for example, contemplate a casing having at least one transparent portion for observing the exterior of the reservoir through the casing, wherein the casing creates a lens that visually changes the appearance of the reservoir. In various exemplary embodiments, the casing may visually alter the appearance of the size and/or shape of the reservoir to an observer viewing the reservoir through the casing. For example, in various exemplary embodiments of the present disclosure, the casing may visually reduce the size of the reservoir to an observer viewing the reservoir through the casing, such that the size and/or shape of the reservoir as observed through the casing appears different than an actual size and/or shape of the reservoir.

As used herein, the term "reservoir" and variations thereof refers to any type and or form of receptacle, chamber, or other device for holding a product, such as, for example, a liquid, semi-liquid, or powered substance, although a solid or semi-solid product also could be placed in the reservoir without departing from the scope of the present disclosure. Accordingly, as used herein, among other things, a reservoir may comprise a container, such as, for example, a plastic container in which the product is held and/or a porous material, such as, for example, pressed fibers of felt, a foam, or the like that can absorb and hold the product.

Various embodiments of the present disclosure, for example, describe and show a cosmetic product for application to the lips that is held within a reservoir. Those of ordinary skill in the art would understand, however, that the present disclosure is not limited to such embodiments, but contemplates various consumer products, including various cosmetic products configured for application to various keratinous surfaces (e.g., skin, hair, nails, eyebrows, and eyelashes), held within various types of reservoirs.

Figure 2:
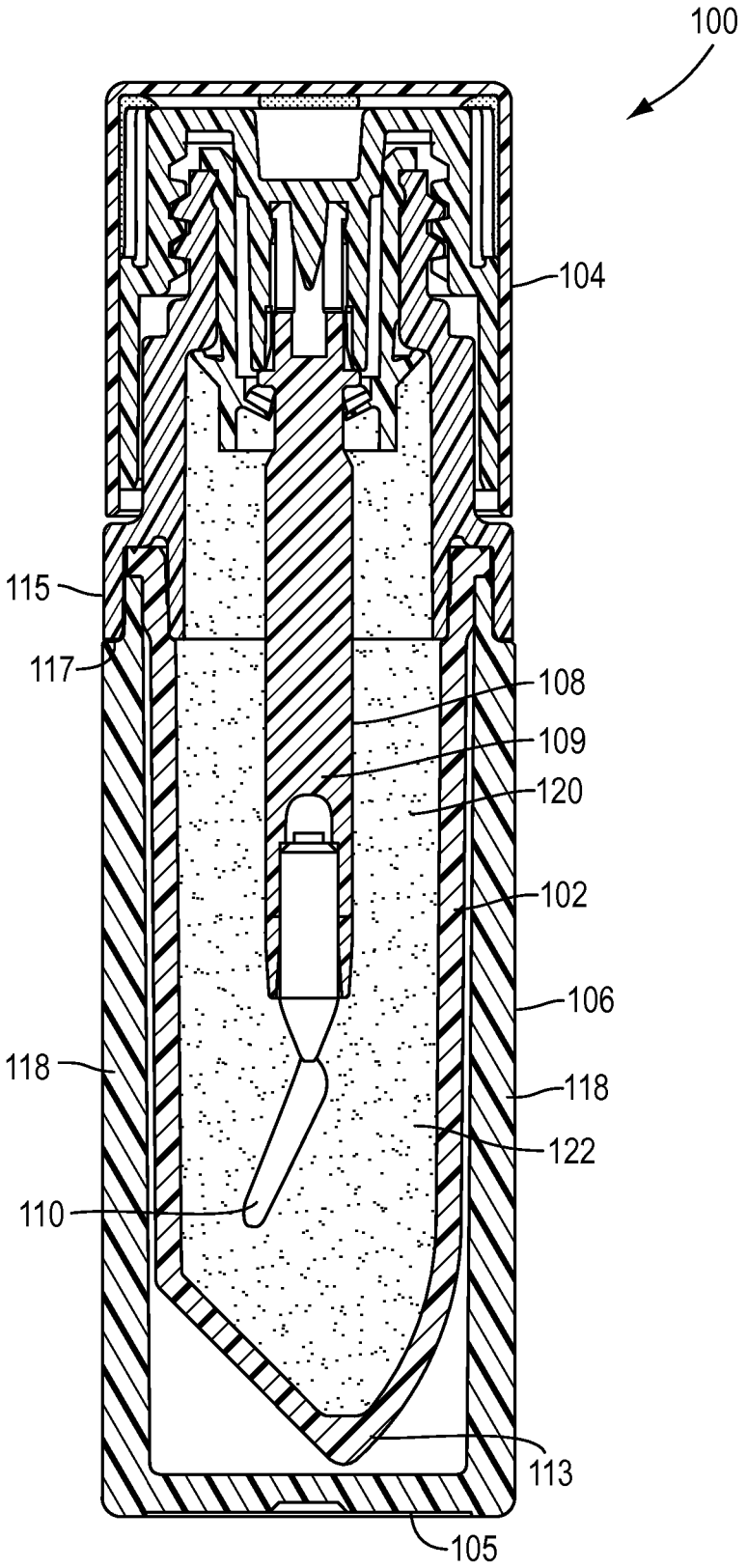
FIG. 2 is a cross-sectional view of the packing system of FIG. 1, taken through line 2-2 of FIG. 1.
Figure 3:
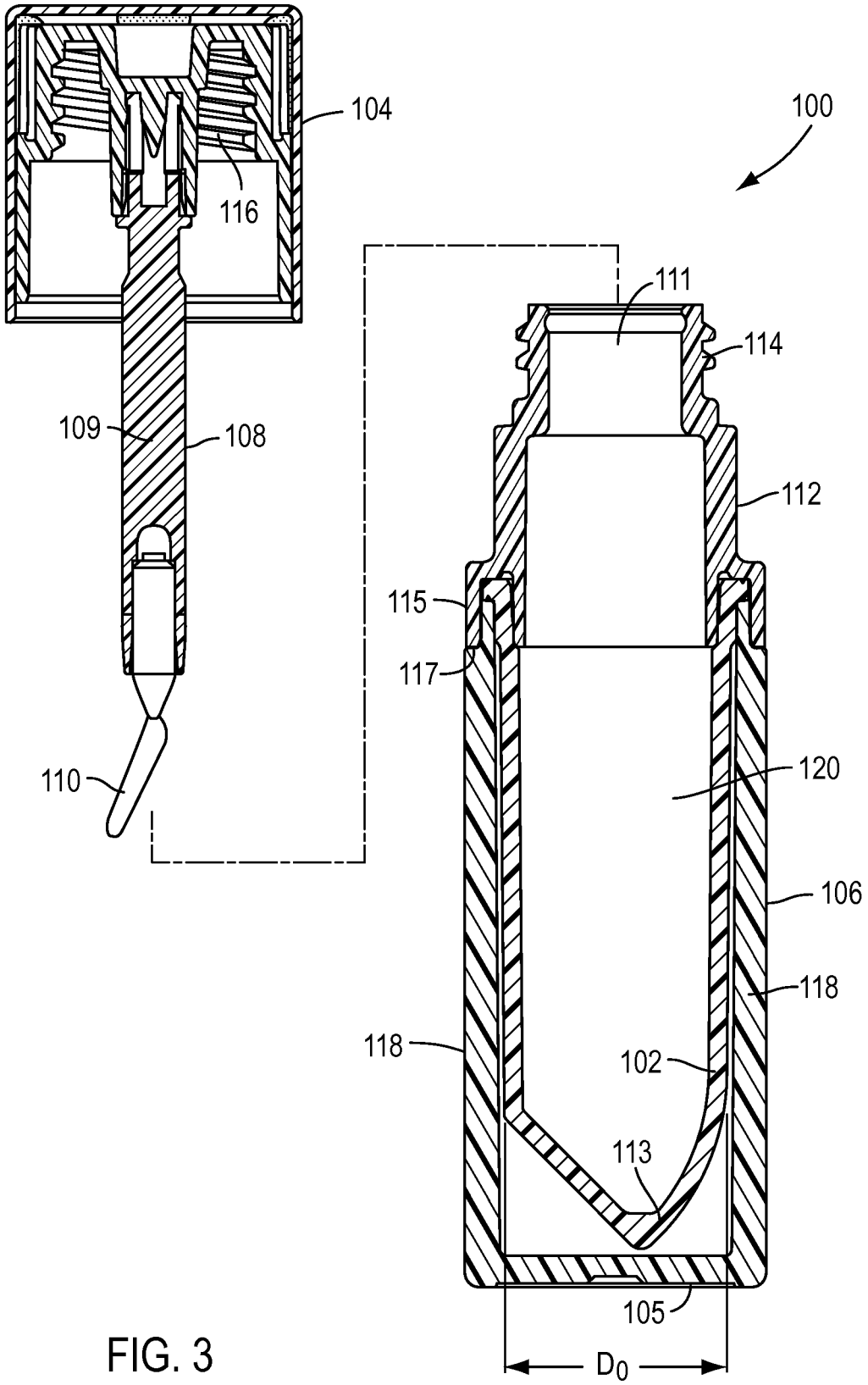
FIG. 3 is a cross-sectional view of the packaging system of FIG. 1, taken through line 2-2 of FIG. 1, in an open configuration.

FIGS. 1-4 illustrate an exemplary packaging system for a cosmetic product in accordance with various exemplary embodiments of the present disclosure. Packaging system 100 includes a reservoir 102, a cap 104, and a casing 106. As shown in FIGS. 2 and 3, the reservoir 102 has an interior volume 120 configured to hold a product. In various embodiments, the reservoir 102 is configured to hold a liquid, semi-liquid, or powered product, such as, for example, a liquid, semi-liquid, or powered cosmetic product, such as, for example, for application to a keratinous surface. In one exemplary embodiment, the cosmetic product may be a lip gloss, lip gel, lip balm, or the like. As shown perhaps best in the open configuration of FIG. 3, the reservoir 102 defines an opening 111 at one end that opens into the interior volume 120 (which provides access to the interior volume 120 and any product held within the interior volume 120). The end 113 opposite opening 111 is closed.

As above, reservoirs in accordance with the present disclosure may have a variety of shapes and designs that are considered to be aesthetically pleasing to a consumer based on, for example, the product held within the reservoir. As shown in FIGS. 1-3, reservoir 102 may be shaped to resemble a bullet of lipstick (e.g., a bullet that is contoured on a distal end). The reservoir interior volume 120 may hold a lip gloss 122 (see FIG. 2) or other liquid or semi-liquid lip cosmetic and may be the same color as the reservoir resembling the bullet of lipstick. In various embodiments, for example, the reservoir 102 can be made of a plastic material that is, for example, molded to resemble a bullet of lipstick. In accordance with this design, and to ensure that the reservoir 102 is also large enough to meet all of the technical parameters of the package, in various embodiments, the reservoir 102 may have an outer diameter $D_o$ (see FIG. 3) ranging from about 10 mm to about 25 mm with an interior volume 120 that holds about 1.0 ml to about 15 ml of lip gloss.

Those of ordinary skill in the art would understand, however, that the reservoir 102 is exemplary only and that reservoirs in accordance with the present disclosure may have various sizes, shapes, designs, configurations, and/or dimensions, based, for example, on the product to be packaged and held within the reservoir. In various additional embodiments, for example, the reservoir can be shaped to resemble a bullet as shown and described below with reference to FIGS. 7-9. It would be further understood that reservoirs in accordance with the present disclosure may be made of various materials, have various colors and/or levels of translucency, and be formed using various methods and/or techniques known to those skilled in the art. In various embodiments, for example, the reservoir may be substantially translucent or transparent, such that the cosmetic product held within the reservoir may be viewed through the reservoir. In still other exemplary embodiments, the reservoir can also serve as an applicator, for example, as a foam applicator for absorbing product and applying it to a keratinous surface.

The cap 104 is configured to be removably coupled to the reservoir 102 to close the opening 111 in the reservoir 102. As shown in FIG. 2, in a closed configuration of the system 100, the cap 104 may, for example, be screwed onto the reservoir 102 to close the opening 111. In various exemplary embodiments, as shown best perhaps in the open configuration of FIG. 3, the reservoir 102 may include an adapter portion 112 that is configured to mate with the cap 104. The adapter portion 112 may include an external threaded portion 114 that is configured to mate with a corresponding internal threaded portion 116 in an interior portion of the cap 104. As also illustrated in FIG. 3, in various embodiments, the adapter portion 112 forms a necked portion 115 and a shoulder 117 at a base of the adapter portion 112 that provides a substantially flush exterior surface with sidewalls 118 of the casing 106.

Those of ordinary skill in the art would understand that the cap 104 and the adapter portion 112 of the reservoir 102 are exemplary only and that the cap 104 may be coupled to the reservoir 102 using various methods and/or techniques known to those skilled in the art, including, for example, via a friction-fit or snap-fit connection. Furthermore, as above, it would be understood by those of ordinary skill in the art that the reservoir 102 may have various configurations, including a two-piece configuration as shown in FIGS. 2 and 3 and a one-piece configuration (not shown), wherein the adaptor portion 112 is formed as a unitary integral piece with the other portions of the reservoir 102.

As shown in FIGS. 2 and 3, in various exemplary embodiments, the system 100 also includes an application member 108 that extends from and beyond the cap 104 so as to be received in the reservoir 102 through the opening 111 when the cap 104 is removably coupled to the reservoir 102. In various embodiments the application member 108 includes a wand 109, an applicator 110, such as, for example, a flocked or foam applicator, located at a distal end of the wand 109. In this manner, when the cap 104 is coupled to the reservoir 102 (e.g., when the system 100 is in the closed configuration illustrated in FIGS. 1 and 2) the application member 108 extends down into the reservoir 102 with at least the applicator 110 positioned within the cosmetic product (e.g., 122) held within the reservoir 102 to load the applicator 110 with the cosmetic product. The cap 104 can be removed with the application member 108 from the reservoir 102 (e.g. as illustrated by the open configuration of the system 100 in FIG. 3) to, for example, apply the lip gloss on the applicator 110 to a lip surface.

Those of ordinary skill in the art would understand, however, that the application member 108 and applicator 110 illustrated in FIGS. 2 and 3 are exemplary only and that application members and applicators of the present disclosure can have various different sizes, shapes, and/or configurations and be formed from various materials without departing from the scope of the present disclosure and claims. In various additional embodiments, for example, the application member 108 may include a bristled, plastic, and/or metal applicator 110, depending, for example, on the type of cosmetic product held within a reservoir (e.g., a bristled applicator may be used in conjunction with a reservoir holding mascara). Furthermore, as illustrated in FIGS. 2 and 3, in various embodiments, the application member 108 is a discrete piece that is fitted (e.g., snap-fitted or the like) within the cap 104. Whereas, in various additional embodiments, the application member 108 may be formed as a unitary integral structure with the cap 104.

Figure 4:
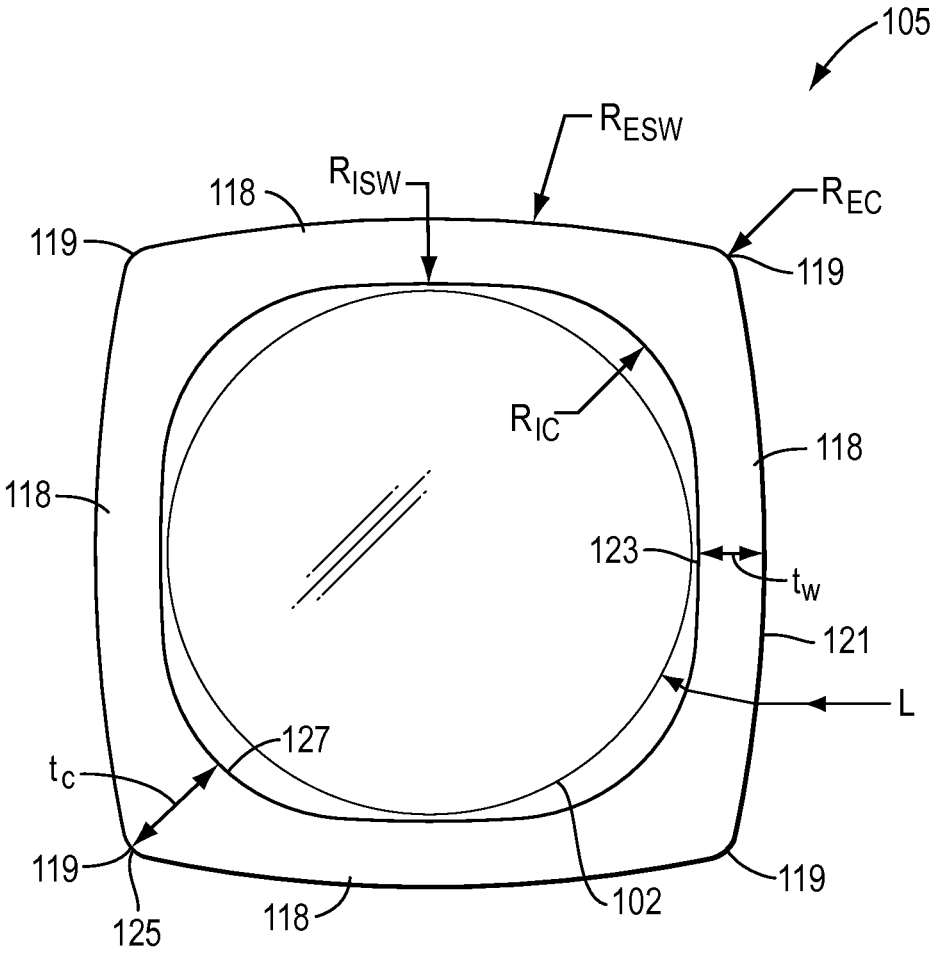
FIG. 4 is a plan view of the packaging system of FIG. 1 from view 4 labeled in FIG. 1.

The casing 106 is positioned at least partially over the reservoir 102. As shown in FIGS. 1-3, in various exemplary embodiments, the casing 106 may be positioned over the closed end 113 of the reservoir 102 to provide a base upon which the reservoir 102 is supported (e.g., in various exemplary embodiments, the reservoir may have a unique shape that would otherwise have difficulty standing upright). In various embodiments, for example, as shown in FIGS. 2-4, the casing 106 may comprise a substantially elongated vial of substantially square or rectangular cross-section, having four side walls 118 and a base 105, into which the reservoir 102 is received. Thus, in various embodiments, as best shown perhaps in FIG. 2, the casing 106 may have a cross-section that is substantially similar to a cross-section of the cap 104, such that when the system 100 is in the closed configuration (i.e., when the cap 104 is coupled to the reservoir 102), the system 100 may have a substantially continuous outer surface, for example, a substantially constant outer dimension and transverse cross-section along a length of the system 100. Those of ordinary skill in the art would understand, however, that casings and caps in accordance with the present disclosure may have various cross-sections, including, for example, circular and oval cross-sections, without departing from the scope of the present disclosure and claims.

As shown in FIG. 1, at least a portion of the casing 106 is transparent so as to permit observation of the reservoir 102 through the casing 106. In various embodiments, for example, the casing 106 may be a molded plastic material that is entirely transparent to view the reservoir 102 through the casing 106. In this manner, the casing 106 may give the appearance that the reservoir 102 is enveloped in a thick wall of plastic. In various embodiments, for example, the casing may be formed from a plastic material, such as, for example, Polyethylene terephthalate (PET), Polyethylene Terephtalate Glycol-modified (PETG), PTA and CHDM Copolyester (PCTA), Glycol-Modified PCT Copolymer (PCTG), Polymethyl methacrylate (acrylic) (PMMA), Clarified Polypropylene (PP), Surlyn, Styrene Acrylonitrile (SAN), Polystyrene, or Clarified Acrylonitrile-Butadiene-Styrene (ABS). In various additional embodiments, the casing may be formed from a colored plastic material or a glass material that permits observation of the reservoir through the casing.

Figure 5A:
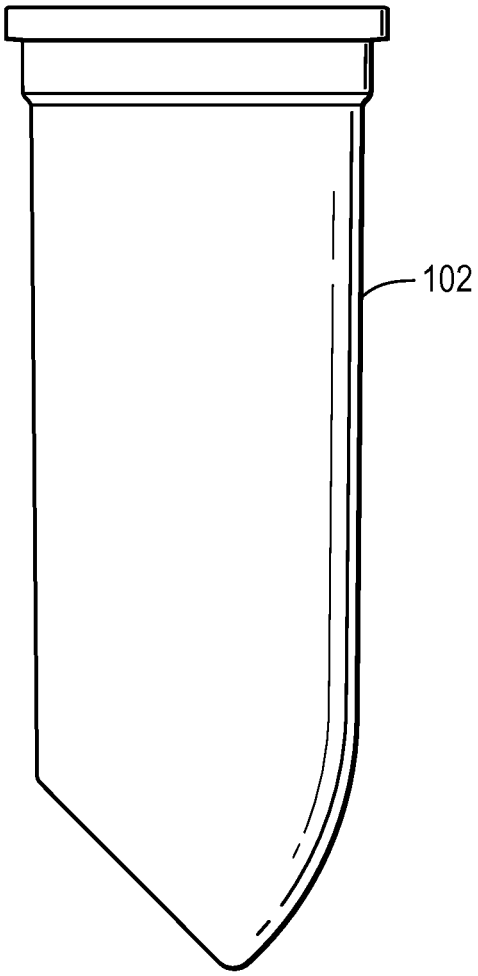
FIG. 5A is a perspective view of the reservoir of the packaging system of FIG. 1.
Figure 5B:
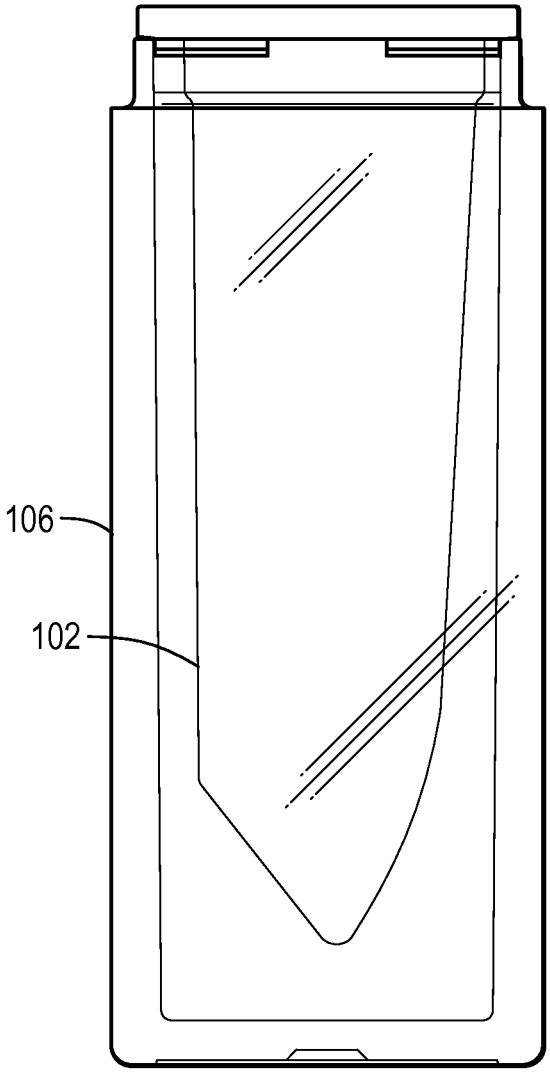
FIG. 5B is a perspective view of the casing and reservoir of the packaging system of FIG. 1 with the reservoir in a received position within the casing.
Figure 6:
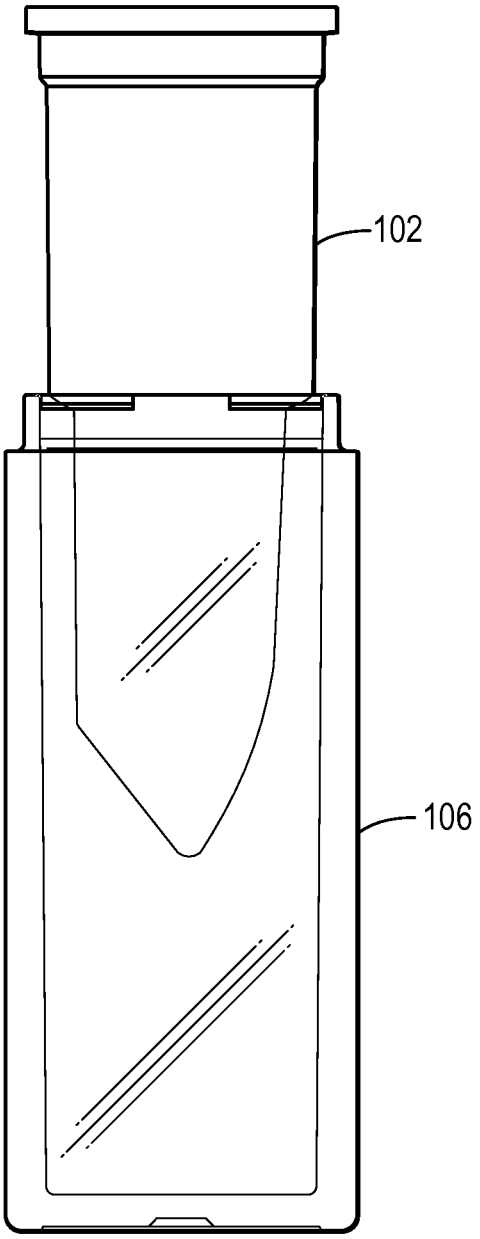
FIG. 6 is a front perspective view of the casing and reservoir of the packaging system of FIG. 1 illustrating how the casing visually alters the appearance of the reservoir as the reservoir is received in the casing.

As illustrated in FIGS. 5A, 5B, and 6, in accordance with various embodiments of the present disclosure, the casing 106 may also be configured to alter the appearance of the reservoir 102 positioned within the casing 106. In various embodiments, for example, to achieve desirable aesthetics and appearance expectations, e.g., size expectations, of the reservoir 102 (e.g., to have an external appearance of the reservoir 102 resemble a bullet of lipstick having a familiar size and shape as shown in FIG. 5B), while also providing a reservoir 102 that is large enough to meet various desirable technical and/or functional parameters of the package, the casing 106 may be configured to visually reduce the appearance of the size of the reservoir 102. In this manner, as best shown perhaps in FIGS. 5A, 5B, and 6, the reservoir 102 received in and observed through the transparent walls 118 of the casing 106 appears to an observer to be smaller than the actual reservoir 102 prior to being received within the casing 106.

In accordance with various exemplary embodiments, the radii of curvature of the side walls 118 and corners 119 of the casing 106 can be manipulated to form a lens that reduces the appearance of the size of the reservoir 102. With reference to FIG. 4, in various embodiments, for example, the side walls 118 of the casing 106 may have a thickness $t_w$ such that the side walls 118 have an exterior radius of curvature $R_{ESW}$ (i.e., for an exterior surface 121 of the side walls 118) and an interior radius of curvature $R_{ISW}$ (i.e., for an interior surface 123 of the side walls 118). In the same manner, the corners 119 may have a thickness $t_c$ such that the corners 119 have an exterior radius of curvature $R_{EC}$ (i.e., for an exterior surface 125 of the corners 119) and an interior radius of curvature $R_{IC}$ (i.e., for an interior surface 127 of the corners 119). While not wishing to be bound by a particular theory, it is believed that the interior corner radius of curvature $R_{IC}$ of the casing 106 in conjunction with the exterior side wall radius of curvature $R_{ESW}$ of the casing 106 creates a lens that may visually reduce the size of the reservoir 102 observed through the casing 106. In other words, it is believed that a combination of these curvatures (the $R_{IC}$ and $R_{ESW}$) forms a reducing lens, which deviates the light that passes through the casing 106 (as shown, for example, by path L in FIG. 4, wherein the path L for only one ray of light is shown for simplicity) to create an optical illusion that makes the reservoir 102 appear smaller than it actually is when observed through the casing 106, as illustrated, for example, in FIGS. 5A, 5B, and 6. In various embodiments, for example, the reservoir 102 may appear to be about 5% to about 40% smaller than it actually is when observed through the casing 106, such as, for example, about 30% to about 40% smaller than it actually is when observed through the casing 106.

In various exemplary embodiments to achieve the desired aesthetic effect of a reservoir 102 having an external appearance resembling a familiar bullet of lipstick (e.g., having an outer diameter ranging from about 7 mm to about 17 mm in various exemplary embodiments), while using a reservoir actually having an outer diameter $D_o$ (see FIG. 3) ranging from about 10 mm to about 25 mm, the thickness of the walls $t_w$ and corners $t_c$ ranges from about 1.0 mm to about 3.5 mm; the exterior side wall radius of curvature $R_{ESW}$ of the casing 106 ranges from about 0.25 mm to about 12.5 mm; and the internal corner radius of curvature $R_{IC}$ of the casing 106 ranges from about 0.25 mm to about 8.56 mm.

Those of ordinary skill in the art would understand, however, that the casing 106 is exemplary only and that the shape, cross-section, size, configuration, and dimensions (e.g., wall/corner thickness and radii of curvature) of the casing can be chosen based on a variety of factors, including, but not limited to, for example, the shape and size of the reservoir positioned within the casing, the type of product, including the application member packaged therein, and the desired aesthetic appearance of the reservoir when received in and observed through the casing. Accordingly, based on the disclosure herein, it is within the ability of one ordinarily skilled in the art to determine the internal corner radius of curvature $R_{IC}$ and the exterior side wall radius of curvature $R_{ESW}$ of the casing for a given reservoir to achieve a desired aesthetic effect (e.g., a reservoir size reduction). For example, in various additional embodiments, the internal corner radius of curvature $R_{IC}$ and the exterior side wall radius of curvature $R_{ESW}$ of the casing for a given reservoir may be configured to achieve a magnifying effect (e.g., a reservoir size increase). As an example, certain cosmetic products (e.g., mascara) may be marketed as having a voluminous effect, in which case it may be desirable to make the reservoir appear larger than it actually is when observed through the casing, while maintaining its actual size useful for the particular application (e.g., to eyelashes). Moreover, in various additional exemplary embodiments, the shape and/or dimensions of the reservoir itself may also be manipulated to achieve the desired aesthetic effect. In other words, once the dimensions of the casing are determined for a given application, the shape and/or dimensions of the reservoir itself may be tweaked to obtain the desired aesthetic effect, as would also be appreciated by those of ordinary skill in the art based on the present disclosure.

Those ordinarily skilled in the art would further understand that the packaging system 100 depicted in FIGS. 1-6 is exemplary only at that various additional packaging configurations for holding various other consumer products (e.g., cosmetic products), are contemplated without departing from the scope of the present disclosure and claims.

Figure 7:
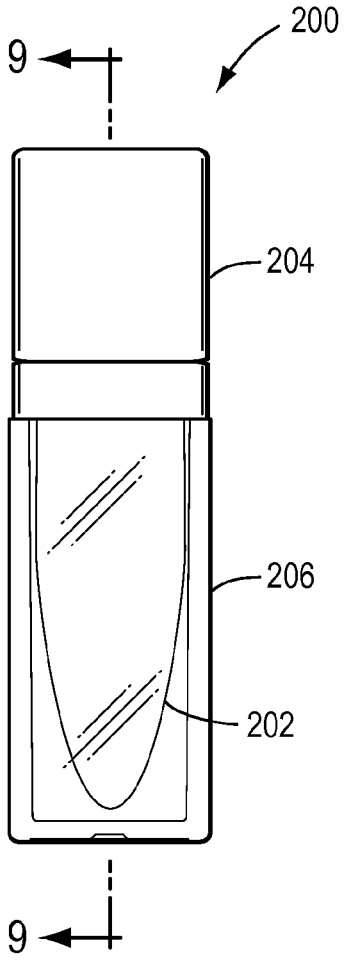
FIG. 7 illustrates another exemplary embodiment of a packaging system in accordance with the present disclosure.
Figure 8:
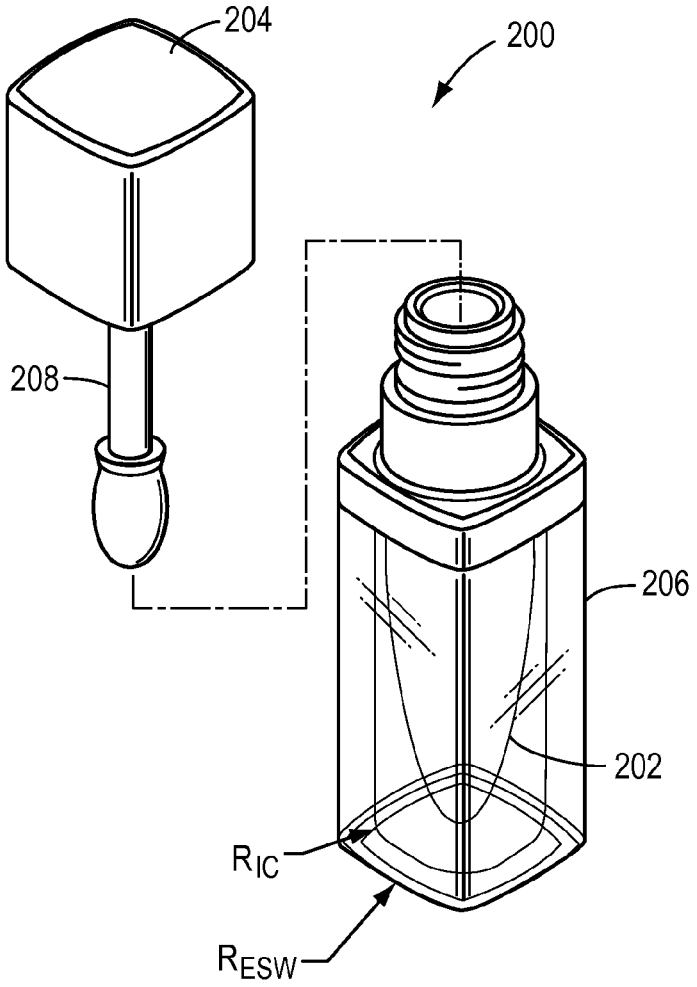
FIG. 8 is a perspective view of the packaging system of FIG. 7 in an open configuration.
Figure 9:
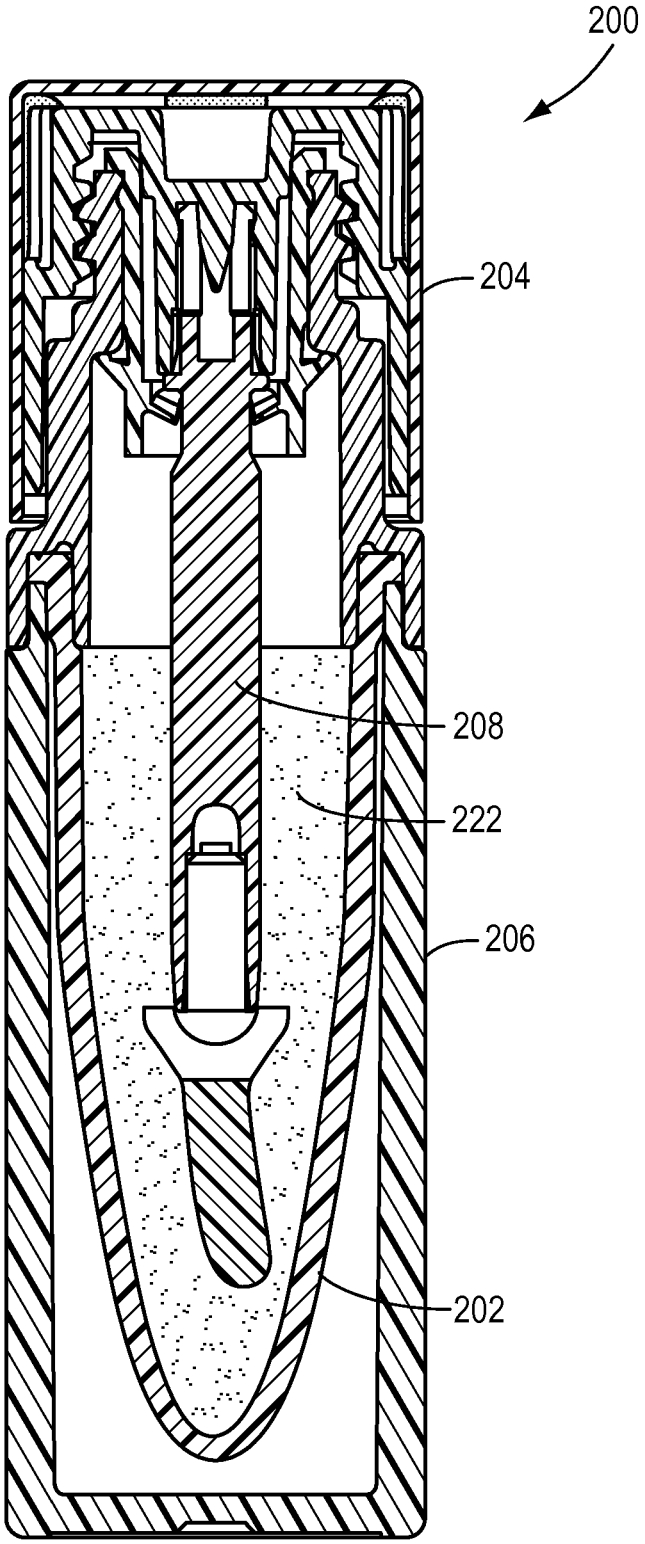
FIG. 9 is a cross-sectional view of the packaging system of FIG. 7, taken through line 9-9 of FIG. 7.

In various additional embodiments, for example, as shown with respect to FIGS. 7-9, a packaging system 200 includes a reservoir 202, a cap 204, a casing 206, and an application member 208. The reservoir 202 may be shaped to resemble a bullet and be configured to hold an eye shadow 222 (see FIG. 9) that is the same color as the reservoir (the bullet), and the casing 206 may be positioned at least partially over the reservoir 202. Similar to the casing 106 of the embodiment of FIGS. 1-6, at least a portion of the casing 206 is transparent so as to permit observation of the reservoir 202 through the casing 206. As shown best perhaps in FIG. 8, in this manner, the casing 206 may give the appearance that the reservoir 202 (i.e., the bullet) is enveloped in a thick wall of plastic. As described in detail above with reference to the packaging system 100, to achieve desirable aesthetics and expectations, e.g., size expectations, of the reservoir 202 (e.g., to have an external appearance of the reservoir 202 resemble a slender bullet), while also providing a reservoir 202 that is large enough to meet various desirable technical and/or functional parameters of the package (e.g., while actually using a reservoir 202 that is larger than aesthetically optimal), the casing 206 may be configured to visually reduce the appearance of the size of the reservoir 202. In various embodiments, for example, an internal corner radius of curvature $R_{IC}$ (see FIG. 8) of the casing 206 and an exterior side wall radius of curvature $R_{ESW}$ (see FIG. 8) of the casing 206 can be manipulated to create a lens that visually reduces the appearance of the size of the reservoir 202 observed through the casing 206.

Furthermore, although the exemplary embodiments of FIGS. 1-9 illustrate a packaging system 100, 200 having a reservoir 102, 202 that is seated within the casing 106, 206, such that the opening of the reservoir 102, 202 is positioned near an open end of the casing 106, 206, in alternative exemplary embodiments, the opening of the reservoir may be positioned near a closed end of the casing (e.g., the casing may be removably positioned over the reservoir), such as, for example, like a conventional lipstick cover (which goes over the bullet of lipstick) or an eyeliner cover (which goes over the tip of the eyeliner). Furthermore, in alternative exemplary embodiments, the reservoir may also function as an applicator member, such as, for example, in embodiments wherein the reservoir is a porous material that retains the product (e.g., like the foam or felt applicator for liquid concealer or foundation).

Figure 10:
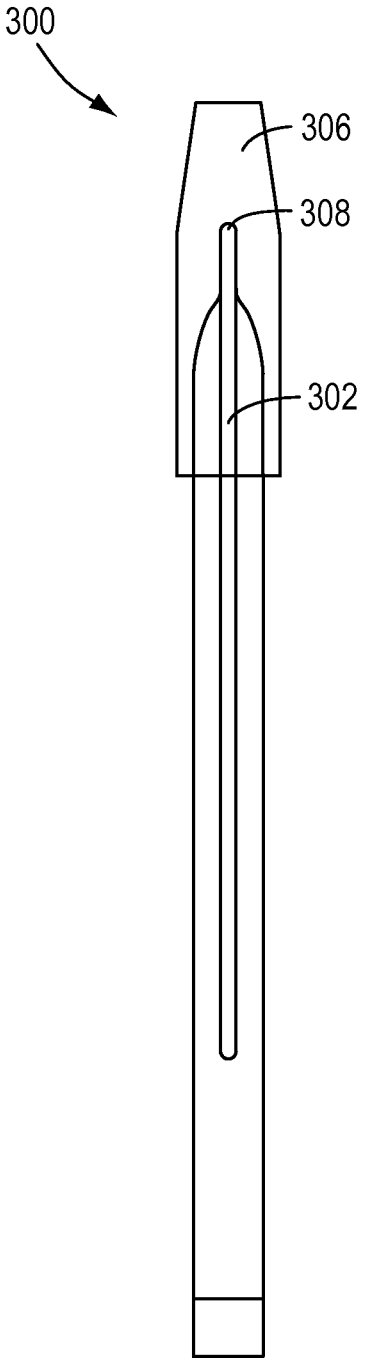
FIG. 10 illustrates another exemplary embodiment of a packaging system in accordance with the present disclosure.

In various additional embodiments, for example, as shown with respect to FIG. 10, a packaging system 300 includes a reservoir 302 and a casing 306. The reservoir 302 may comprise an exposed application tip 308 (e.g., a fine felt tip) that is filled, for example, with liquid eyeliner from the reservoir 302. The casing 306 may be positioned at least partially over the reservoir 302 and tip 308. Similar to the above embodiments, at least a portion of the casing 306 is transparent so as to permit observation of the tip 308 through the casing 306. In this manner, the casing 306 may be configured to visually alter the appearance of (such as, for example, reduce) the size and/or shape of the application tip 308 of the reservoir 302.

Figure 11:
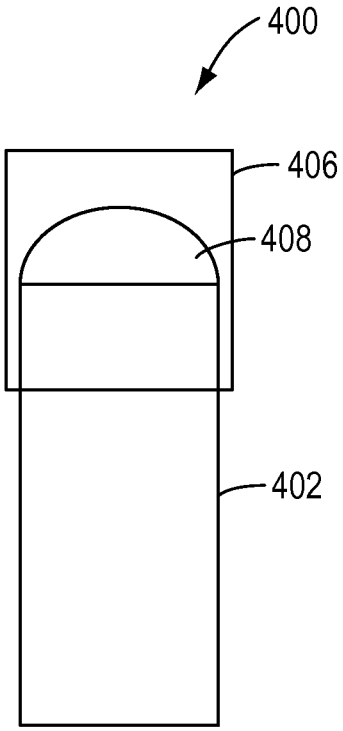
FIG. 11 illustrates yet another exemplary embodiment of a packaging system in accordance with the present disclosure.

In various further embodiments, as shown with respect to FIG. 11, a packaging system 400 includes a reservoir 402 and a casing 406. The reservoir 402 may comprise an exposed application surface 408 (e.g., a foam or felt applicator) that absorbs product, such as, for example, liquid concealer or foundation, and the casing 406 may be positioned at least partially over the reservoir 402. As above, at least a portion of the casing 406 is transparent so as to permit observation of the reservoir 402 through the casing 406. In this manner, the casing 406 may be configured to visually alter the appearance of (such as, for example, reduce) the size and/or shape of the application surface 408 of the reservoir 402.

An exemplary method for packaging a cosmetic product in accordance with an exemplary embodiment of the present disclosure is set forth in the following description. In accordance with various embodiments, to enhance the aesthetic appeal of a product, such as, for example, a cosmetic product, a transparent casing for positioning at least partially over a reservoir configured to hold the cosmetic product can be configured such that a size and/or shape of the reservoir as observed through the casing appears different than an actual size and/or shape of the reservoir. The casing may, for example, be configured such that that size and/or shape of the reservoir as observed through the casing appears smaller than the actual size and/or shape of the reservoir. In various embodiments, for example, as set forth in the exemplary embodiments of FIGS. 1-11 above, a transparent casing 106, 206, 306, 406 for positioning over a reservoir 102, 202, 302, 402 configured to hold a cosmetic product can be configured such that the size of the reservoir 102, 202, 302, 402 as observed through the casing 106, 206, 306, 406 appears smaller than the actual size of the reservoir.

In various embodiments, for example, the transparent casing 106, 206, 306, 406 may have walls and corners such that the casing 106, 206, 306, 406 has a substantially square cross-section. The side walls and corners may each have a respective thickness such that the walls and corners have exterior radii of curvature and interior radii of curvature. In various embodiments, an exterior radius of curvature $R_{ESW}$ of the side walls of the casing 106, 206, 306, 406 and an internal radius of curvature $R_{IC}$ of the corners of the casing 106, 206, 306, 406 may form a lens portion of the casing 106, 206, 306, 406 that alters the appearance of the reservoir 102, 202, 302, 402 observed through the casing 106, 206, 306, 406.

As illustrated with reference to the exemplary embodiment of FIGS. 1-6, various embodiments of the present disclosure contemplate configuring a transparent casing 106 for positioning over a reservoir 102 that is sized and shaped to have a lipstick shape and configured to hold a lip gloss 122, such that the size of the reservoir 102 as observed through the casing 106 appears smaller than the actual size of the reservoir 102. In other words, the casing 106 may be configured to visually reduce the size of the reservoir 102 such that the lipstick observed through the casing 106 appears to have a familiar size and shape. As illustrated with reference to the exemplary embodiment of FIGS. 7-9, various additional embodiments of the present disclosure contemplate a transparent casing 206 for positioning over a reservoir 202 that is sized and shaped to have a bullet shape and configured to hold an eye shadow 222, such that the size of the reservoir 202 as observed through the casing 206 appears smaller than the actual size of the reservoir 202. In other words, the casing 106 may be configured to visually reduce the size of the reservoir 202 such that the bullet shape viewed through the casing 206 appears to be smaller than it actually is.

As above, however, those of ordinary skill in the art would understand, that reservoirs 102, 202, 302, and 402 are exemplary only and that reservoirs in accordance with the present disclosure can have various shapes, sizes, and/or configurations, and may hold various products, based on a particular application. Accordingly, it would be understood, that the present disclosure contemplates configuring a transparent casing, as disclosed herein, for positioning at least partially over various shapes and/or sizes of reservoirs (which are configured to hold various types of products), in order to obtain various visual effects.

Although the detailed description and exemplary illustrated embodiments were described with reference to packaging systems for cosmetic products, such as, makeup, it will be appreciated by those ordinarily skilled in the art having the benefit of this disclosure that the present disclosure may also provide packaging systems and methods for various additional cosmetic products and applications, such as, for example, various dermatological applications. Furthermore, the present disclosure is not limited to cosmetic applications (but may also be utilized for non-cosmetic applications), and the embodiments described could be used for a variety of purposes in which it is desirable to package a product in a manner that visually alters the appearance of the product and/or a reservoir holding the product to achieve a desired aesthetic effect. Further modifications and alternative embodiments to accommodate such applications would be apparent to those skilled in the art in view of this description.

The packaging systems may also include additional components that were omitted from the drawings for clarity of illustration. Accordingly, this description is to be construed as illustrative only and is for the purpose of teaching those skilled in the art the general manner of carrying out the present disclosure.

It is to be understood that the various embodiments shown and described herein are to be taken as exemplary. Elements and materials, and arrangements of those elements and materials, may be substituted for those illustrated and described herein, parts may be reversed, and certain features of the present disclosure may be utilized independently, all as would be apparent to one skilled in the art after having the benefit of the description herein. Changes may be made in the elements described herein without departing from the spirit and scope of the present disclosure and following claims, including their equivalents.

It is to be understood that the particular examples and embodiments set forth herein are non-limiting, and modifications to structure, dimensions, materials, and methodologies may be made without departing from the scope of the present disclosure.

It is to be further understood that this description's terminology is not intended to limit the invention. For example, spatially relative terms, such as "front", "back," "top", "bottom", "side," and the like, may be used to describe one element's or feature's relationship to another element or feature as intended to connote the orientation of the container for display and use and as illustrated in the figures. These spatially relative terms are intended to encompass different positions (i.e., locations) and orientations (i.e., rotational placements) of a container in use in addition to the position and orientation shown in the figures. For example, if a container in the figures is turned over, elements described as "top" or "bottom" would then be reversed. A container may also be otherwise oriented (rotated 90 degrees or at other orientations) and the spatially relative descriptors used herein interpreted accordingly.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present disclosure have been described in detail with respect to various exemplary embodiments thereof, it should not be considered limited to such, as numerous modifications are possible without departing from the broad scope of the appended claims, including the equivalents they encompass.

We claim:

1. A packaging system for a cosmetic product, the system comprising:

a reservoir for holding a cosmetic product, the reservoir defining an open end and a closed end opposite the open end; and a casing comprising side walls positioned at least partially over the reservoir, wherein at least a portion of the casing is transparent for observing the reservoir through the casing, and a cap configured to be removably coupled to the reservoir to close the open end of the reservoir;

an application member extending from the cap and configured to be received in the reservoir in a position of the cap being removably coupled to the reservoir;

wherein a size and/or shape of the reservoir as observed through the side walls of the casing appears different than an actual size and/or shape of the reservoir.

2. The packaging system of claim 1, wherein the application member comprises a wand and an applicator located at a distal end of the wand.

3. The packaging system of claim 2, wherein the applicator comprises a flocked, foam, or bristled applicator.

4. The packaging system of claim 1, wherein the reservoir has a bullet shape.

5. The packaging system of claim 1, wherein the reservoir has a lipstick shape.

6. The packaging system of claim 1, further comprising the cosmetic product held within the reservoir.

7. The packaging system of claim 6, wherein the cosmetic product is a liquid or semi-liquid make-up product.

8. The packaging system of claim 7, wherein the cosmetic product is lip gloss, lip balm, eye shadow, mascara, eyeliner, or concealer.

9. The packaging system of claim 1, wherein the casing is made of a molded plastic.

10. The packaging system of claim 1, wherein the casing is transparent.

11. The packaging system of claim 1, wherein the reservoir is transparent or translucent.

12. The packaging system of claim 1, wherein the size and/or shape of the reservoir as observed through the casing appears smaller than the actual size and/or shape of the reservoir.

13. The packaging system of claim 12, wherein the size and/or shape of the reservoir as observed through the casing appears about 5% to about 40% smaller than the actual size and/or shape of the reservoir.

14. The packaging system of claim 1, wherein the casing has sidewalls and corners such that the casing has a substantially square cross-section.

15. The packaging system of claim 14, wherein an interior radius of curvature of the corners and an exterior radius of curvature of the side walls form a lens.

16. The packaging system of claim 15, wherein the interior radius of curvature of the corners and the exterior radius of curvature of the side walls form a reducing lens.

17. The packaging system of claim 15, wherein the interior radius of curvature of the corners ranges from about 0.25 mm to about 8.56 mm.

18. The packaging system of claim 17, wherein the exterior radius of curvature of the side walls ranges from about 0.25 mm to about 12.5 mm.

19. The packaging system of claim 1, wherein the reservoir has an outer diameter ranging from about 10 mm to about 25 mm.

20. The packaging system of claim 1, wherein the reservoir has an internal volume that ranges from about 1.0 ml to about 15 ml.

21. A method for packaging a cosmetic product, the method comprising:

configuring a transparent casing for positioning at least partially over a reservoir configured to hold a cosmetic product such that a size and/or shape of the reservoir as observed through the side walls of the casing appears different than an actual size and/or shape of the reservoir;

configuring a cap to be removably coupled to the reservoir to close the open end of the reservoir;

wherein the cap comprises an application member extending from the cap and configured to be received in the reservoir in a position of the cap being removably coupled to the reservoir.

22. The method of claim 21, wherein the reservoir has a bullet shape.

23. The method of claim 21, wherein the reservoir has a lipstick shape.

24. The method of claim 21, wherein configuring the transparent casing comprises forming side walls and corners of the casing such that the casing has a substantially square cross-section, wherein forming the side walls and corners of the casing comprises forming side walls and corners each having a respective thickness such that the side walls and corners have exterior radii of curvature and interior radii of curvature, and wherein forming the side walls and corners of the casing further comprises forming a lens portion of the casing with an exterior radius of curvature of the side walls and an interior radius of curvature of the corners.

25. The method of claim 21, wherein configuring the transparent casing such that the size and/or shape of the reservoir as observed through the casing appears different than the actual size and/or shape of the reservoir comprises configuring the transparent casing such that the size and/or shape of the reservoir as observed through the casing appears smaller than the actual size and/or shape of the reservoir.

* * * * *